US007737925B2

(12) United States Patent
Giraldo et al.

(10) Patent No.: US 7,737,925 B2
(45) Date of Patent: Jun. 15, 2010

(54) ACTIVE MATRIX PIXEL CELL WITH MULTIPLE DRIVE TRANSISTORS AND METHOD FOR DRIVING SUCH A PIXEL

(75) Inventors: Andrea Giraldo, S-Hertogenbosch (NL); Mark T. Johnson, Veldhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 682 days.

(21) Appl. No.: 10/536,841

(22) PCT Filed: Nov. 27, 2003

(86) PCT No.: PCT/IB03/05466

§ 371 (c)(1),
(2), (4) Date: May 31, 2005

(87) PCT Pub. No.: WO2004/051617

PCT Pub. Date: Jun. 17, 2004

(65) Prior Publication Data

US 2006/0071879 A1 Apr. 6, 2006

(30) Foreign Application Priority Data

Dec. 4, 2002 (EP) ..... 02102679

(51) Int. Cl.
*G09G 3/32* (2006.01)

(52) U.S. Cl. ..... 345/82; 345/206

(58) Field of Classification Search ..... 345/55, 345/76, 81–82, 206, 204; 362/561
See application file for complete search history.

(56) References Cited

U.S. PATENT DOCUMENTS

| | | | | |
|---|---|---|---|---|
| 6,011,529 | A | 1/2000 | Ikeda | |
| 6,433,488 | B1 * | 8/2002 | Bu | 315/169.3 |
| 6,750,840 | B2 * | 6/2004 | Morita | 345/100 |
| 6,853,371 | B2 * | 2/2005 | Miyajima et al. | 345/206 |
| 6,859,193 | B1 * | 2/2005 | Yumoto | 345/82 |
| 6,876,350 | B2 * | 4/2005 | Koyama | 345/92 |
| 7,053,873 | B2 * | 5/2006 | Tsutsui | 345/76 |
| 2002/0047555 | A1 * | 4/2002 | Inukai | 315/169.3 |
| 2002/0140642 | A1 * | 10/2002 | Okamoto | 345/76 |

FOREIGN PATENT DOCUMENTS

| | | |
|---|---|---|
| EP | 1170718 A | 1/2002 |
| WO | WO 02/17289 A1 | 2/2002 |
| WO | WO 0217289 | 2/2002 |

* cited by examiner

*Primary Examiner*—Chanh Nguyen
*Assistant Examiner*—Calvin C Ma

(57) ABSTRACT

A pixel cell in an active matrix display comprising a current driven emissive element such as an OLED (20) and a data input (17) for receiving an analogue data signal ($V_{in}$). The pixel has at least two drive elements (12, 14), each being connected to a power supply (16) and arranged to drive the emissive element in accordance with the data signal, and selecting means (22, 24) for providing, in response to a select signal (21, 23), the data signal to at least one of the drive elements (12, 14). Further, each drive element is adapted to drive the emissive element (20) in a different drive current range in response to a given data signal. Thereby, a required brightness range can be obtained while data voltages too close to the threshold voltage may be avoided.

18 Claims, 4 Drawing Sheets

ACTIVE MATRIX PIXEL CELL WITH MULTIPLE DRIVE TRANSISTORS AND METHOD FOR DRIVING SUCH A PIXEL

The present invention relates to a pixel cell in an active matrix display comprising a light emissive element, such as an OLED (organic light emitting diode) and a data input for receiving an analogue data signal. The invention also relates to a display comprising such pixel cells, and a driving method for such a pixel cell.

For large active matrix displays, such as AM-OLEDs, both polymer and small molecules, display uniformity is one of the most important issues. The main reason for display non-uniformity is the variation of the threshold voltage of the pixel driving transistors across the polycrystalline silicon plate.

A conventional pixel circuit for an AM-OLED display is shown in FIG. 1. It has a selection transistor 1 that allows writing of the data voltage ($V_{in}$) into a store point 2. This voltage determines the gate voltage of a driving transistor 3 with respect to the power line 4. If the gate voltage ($V_{gs}$) is larger than the threshold voltage ($V_t$), current is delivered to the OLED 5 and light is generated. In formula $L \propto W (V_{gs} - V_t)^2$, where L is the illumination brightness and W is the channel width of the driving transistor. This relationship is illustrated in FIG. 2. (Note that $V_{gs}$ and $V_t$ in FIG. 2 are negative, so that in fact $V_{gs}$ should be less than $V_t$ to activate drive of the transistor.) Operation at voltages close to the threshold voltage implies low brightness levels, which are essential for satisfactory display of gray scales images. However, this region is also very sensitive to any threshold variation, and therefore non-uniformity is higher. Conversely, the higher the brightness levels, the better the uniformity.

An object of the present invention is to improve the non-uniformity of active matrix displays, also at low brightness levels.

According to a first aspect of the present invention, this and other objects are achieved by a pixel cell of the type mentioned by way of introduction, further comprising at least two drive elements, each being connected to a power supply and arranged to drive the emissive element in accordance with the data signal, and selecting means for providing, in response to a select signal, the data signal to at least one of the drive elements. Further, each drive element is adapted to drive the emissive element in a different drive current range in response to a given data signal.

According to a second aspect of the invention, this and other objects are achieved with a method for driving a pixel cell comprising an emissive element and at least two drive elements for driving the emissive element, each drive element being adapted to drive the emissive element in a different drive current range in response to a given data signal. The method comprises generating, based on an analogue video signal belonging to a first voltage range, a data signal belonging to a second, more narrow voltage range, and associating the data signal with a select signal indicating a desired drive current range, and providing the data signal and the select signal to the pixel cell.

The select signal is used to direct the second data signal to a suitable drive element, arranged to generate the desired drive current range.

According to a further aspect of the invention, this and other objects are achieved by a display device comprising a plurality of pixel cells according to the first aspect of the invention. The display further comprises a control unit, arranged to receive a first analogue data signal belonging to a first voltage range, to generate a second analogue data signal belonging to a second, more narrow voltage range, and to associate said data signal with a select signal indicating a desired drive current range. The display also comprises means for providing the data signal and the select signal to one of said pixel cells.

The select signal is again used to direct the second data signal to a suitable drive element, arranged to generate the desired drive current range.

The invention is based on the idea to map a larger voltage range, representing a certain required drive current range, onto a smaller voltage range associated with a select signal. This analogue data signal, belonging to a specified voltage range, is then directed to a suitable drive element using the select signal. The selected drive element is adapted to generate a specific drive current range, so that the entire required drive current range can be obtained.

For example, a first drive element can generate a drive current resulting in a brightness in the range L1-L2, while a second drive element can generate a drive current resulting in a brightness in the range L2-L3, both for same data signal range, safely separated from the threshold voltage. A combination of these drive elements according to the invention results in pixel cell capable of generating brightness is the range L1-L3 from the same restricted data signal voltage range.

Pixel cells with a plurality of drive elements, each providing different drive voltages, are known from e.g. WO02/17289. However, the device according to WO02/17289 is directed to digital data signals, and the different drive voltages correspond to the different bits of the data signal. In other words, in a pixel cell according to WO02/17289 all drive elements are selected at the same time (connected to the same select signal). Each drive element is then provided with only one bit of the data signal, and the value of this bit determines whether a particular element is activated. In short, each pixel cell is provided with one common select signal, but several different data signals.

According to the present invention, on the contrary, the select signal is arranged to control each individual drive element. The provided analogue data signal is then provided to each activated drive element.

According to a preferred embodiment, the first voltage range comprises voltages which are closer to threshold voltages of the pixel cell drive elements than any voltages in the second voltage range. Thereby, a satisfactory light emission range can be obtained while data voltages too close to the threshold voltage may be avoided.

The selecting means can comprise at least two switches, each arranged to be provided with a separate select signal which thereby determines the drive current range resulting from a given data signal. This is an efficient way to realize the selecting means.

Each switch can be arranged to receive a select signal which is set either ON or OFF (i.e. enables or disables the drive means connected to the switch) during an entire frame period. This means that the data signal can be supplied to the switches during the entire period, and only switches receiving an ON signal will provide the data signal to their drive element.

Alternatively, each switch is arranged to receive a select signal which is alternated ON and OFF during the frame period. In this case, the data signal is supplied to the switches only during a portion of the frame period, and where this portion coincides with a period with an ON select signal, the data signal is provided to the respective drive element. An advantage is that the select signal can be generated independently of the data signal.

It may be advantageous to generate the select signals from one common select signal. As an example, one select signal can easily be used as two opposite select signals with the help of an inverter, or by using switches with opposite switching characteristics (e.g. NMOS and PMOS transistors).

The drive elements can comprise transistors having different transistor channel dimensions, thereby accomplishing the different drive current ranges.

The current driven emissive element can be a LED, for example an organic LED (OLED), but also any other type of current driven emissive element.

These and other aspects of the invention will be apparent from the preferred embodiments more clearly described with reference to the appended drawings.

Figure 1:
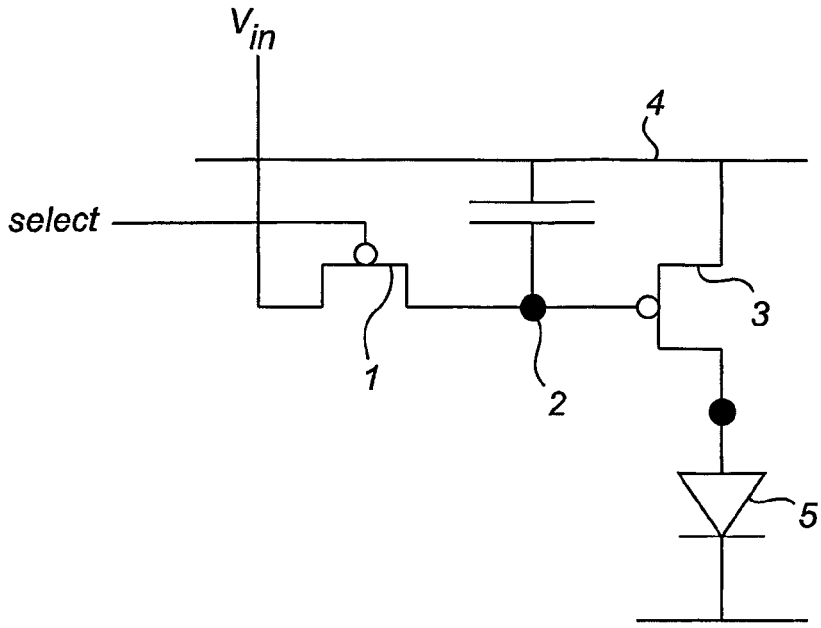
Fig. 1 (Prior art)
FIG. 1 is a circuit diagram of a pixel cell according to prior art.
Figure 2:
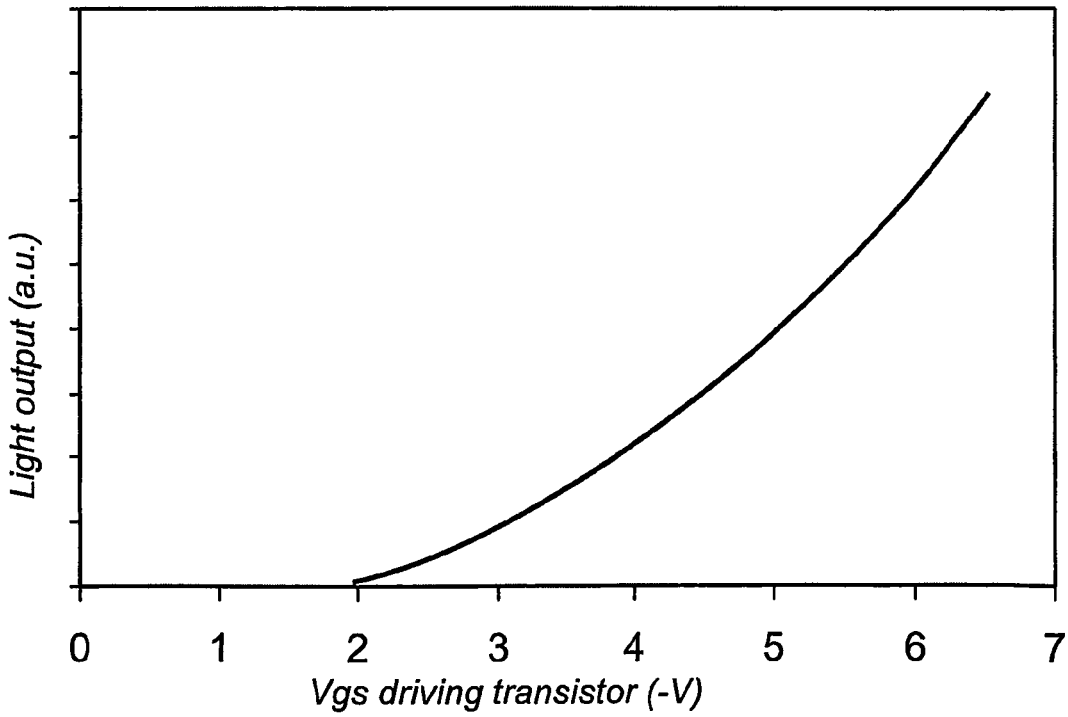
FIG. 2 is a diagram showing the relationship between gate voltage and the resulting brightness for a conventional drive element.
Figure 3:
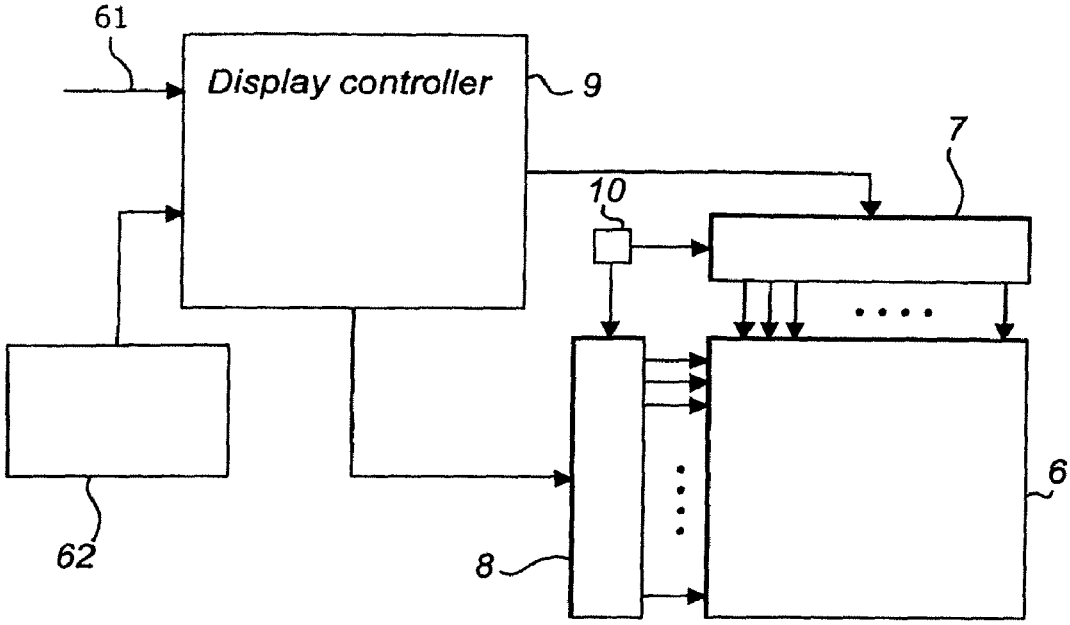
FIG. 3 is a block diagram of a display device according to an embodiment of the present invention.

FIG. 3 illustrates an active matrix OLED display device comprising an OLED display 6 (e.g. small-molecules or polymer) having a plurality of pixel cells according to the present invention. The pixel cells are individually addressed with a row driver 7 and a column driver 8, which are controlled by a display controller 9 and synchronized by means of a synchronizing unit 10.

Figure 4:
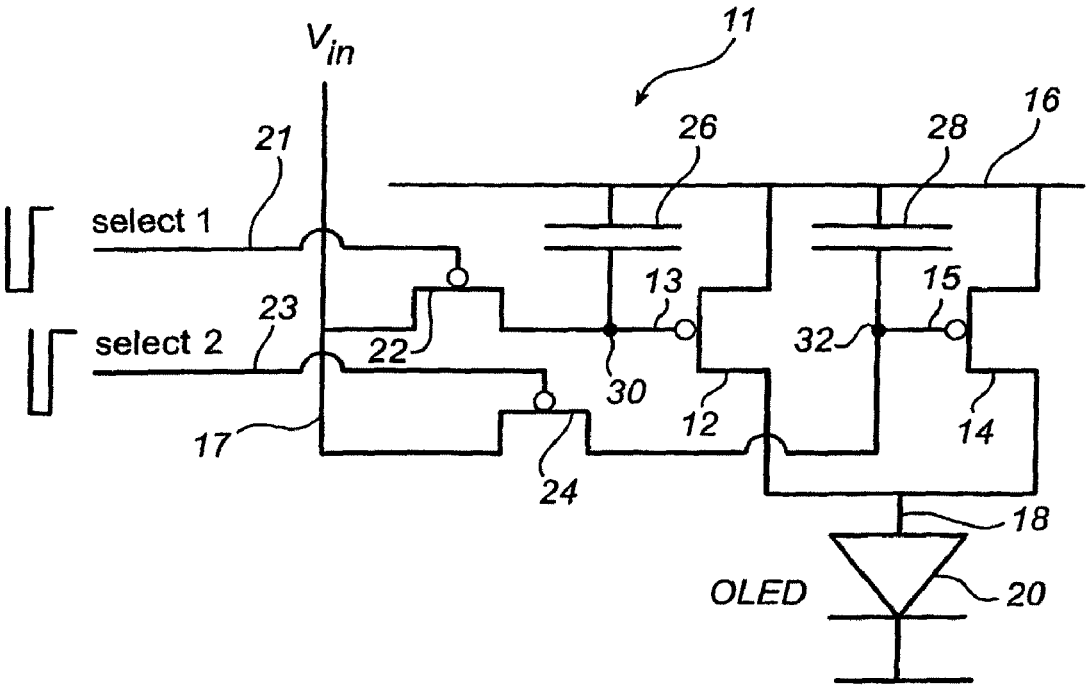
FIG. 4 is a circuit diagram of a pixel cell according to a first embodiment of the invention.

FIG. 4 illustrates a pixel cell 11 according to a first embodiment of the invention, having a plurality, in this case two, drive elements, here in the form of driving transistors 12, 14 connected between a power line 16 and the anode 18 of an OLED 20. Each driving transistor 12, 14 has a different channel width (W) so that they will generate different drive currents when fed with the same gate voltage.

The gate 13, 15 of each driving transistor 12, 14 is connected to a switch, here in the form of a selection transistor 22, 24, and also to a memory element, here in the form of a storage capacitor 26, 28. Each switch receives an analogue data signal from a data line 17, and a select signal from select lines 21, 23. In short, the pixel cell comprises two completely redundant static cells, each comprising a drive cell and a memory cell, one for low brightness one for higher brightness, connected to the same data signal but to different select signals.

Figure 5:
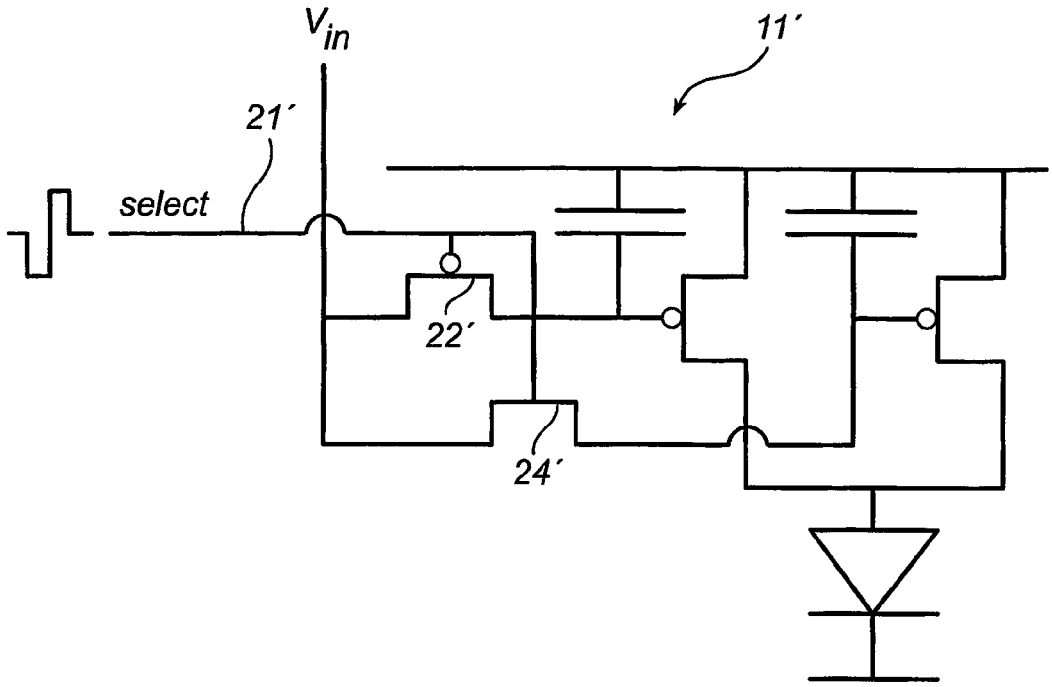
FIG. 5 is a circuit diagram of a pixel cell according to a second embodiment of the invention.

FIG. 5 illustrates a pixel cell 11' according to a second embodiment. While the circuit in FIG. 4 has two separate select lines 21, 23 feeding the switches 22, 24, the circuit in FIG. 5 has a single selection line 21' feeding both switches 22', 24'. In this case the two selection transistors must be arranged to react differently to the same select signal, for example by providing an inverter before one of the switches, or by using complementary transistors (NMOS and PMOS).

During selection of the first driving transistor 12 the data voltage ($V_{in}$) is written from the data line 17 into the store point 30, and during selection of the second driving transistor 14 the data voltage ($V_{in}$) is written from the data line 17 into the store point 32.

As mentioned, the two transistors 12, 14 have different channel size (in particular the width) and when operating in a given gate voltage range they cover different brightness levels.

In formula $L \sim W_1 (V_{gs1}-V_{t1})^2+W_2 (V_{gs2}-V_{t2})^2$, where $W_1$ and $W_2$ are the channel widths of the first and second transistors 12, 14, $V_{gs1}$, $V_{gs2}$ are the gate-to-source voltages of each transistor, and $V_{t1}$, $V_{t2}$ are the threshold voltages of each transistor. Assuming $W_1<W_2$, the transistor 12 with $W_1$ is used for smaller brightness, while for higher brightness transistor 14 with width $W_2$ is used. The gate-to-source voltage range is chosen so that the voltage $V_{gs}$ is much higher (or lower, when $V_{gs}$ and $V_t$ are negative) than the threshold voltages $V_{t1}$, $V_{t2}$ for both transistors 12, 14.

Figure 6:
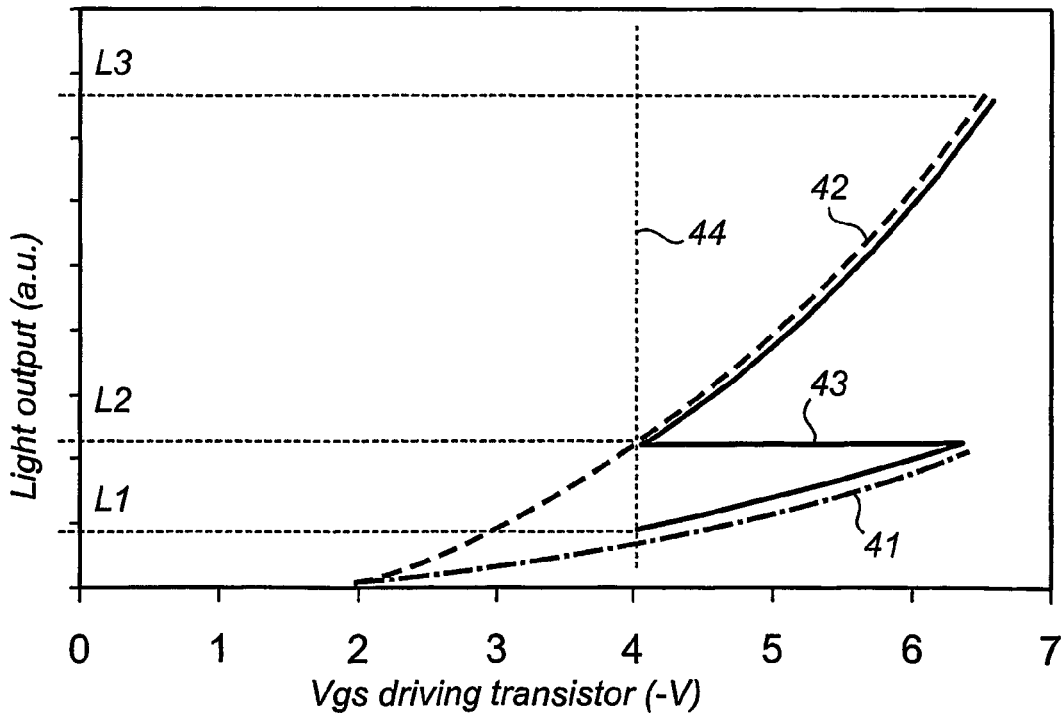
FIG. 6 is a diagram showing the relationship between gate voltage and resulting brightness for a pixel cell according to the invention with two drive elements.

This is illustrated in FIG. 6, where the first transistor 12 is used to generate brightness levels between L1 and L2 and the second transistor 14 is used to generate brightness levels between L2 and L3. The region to the right of line 44 represents gate voltages sufficiently high to avoid non-uniformity, i.e. they are sufficiently much larger than the threshold voltage of the transistors. As is clear from FIG. 6, a brightness in the entire range between L1 and L3 can be obtained with a gate voltage in this region (in the illustrated example within the range 4 V to 6.5 V), by switching between transistor 12 and transistor 14. In this voltage interval, the curve 41 representing the first transistor 12 characteristics runs between L1 and L2, while the curve 42 representing the second transistor 14 characteristics runs between L2 and L3. By joining these sections of the curves 41 and 42, a third curve 43 is formed, representing the characteristics of the pixel cell according to this embodiment of the invention.

In order to obtain level L1 with only transistor 14 the gate voltage would have to be decreased to around 2 V, which increases the risk for non-uniformity. With only transistor 12, the gate voltage would not need to be below 4 V, but a much higher voltage, probably far above 10 V, would be required to reach L3.

In FIG. 6, the levels L1 and L2 are obtained by applying the same voltage (4 V) to transistor 12 and 14 respectively, and the same is true for levels L2 and L3 (6.5 V). It should be noted this is only a special case, and not a limitation on the present invention. However, it allows for a satisfactory utilization of the transistor's operating ranges.

For data signals corresponding to brightness levels below L1, both driving transistors can be provided with gate voltages below the threshold voltage ($V_t$), i.e. the pixel is in a "dark" state, or turned off. The choice of L1 must be sufficiently high so that the gate voltage $V_{gs}$ that results in this brightness level when connected to the first transistor gate 13 is sufficiently much greater than the threshold voltage $V_t$. At the same time, L1 must be low enough to give good perception, i.e. avoid unnecessary contouring of dark states.

A further advantage with a pixel according to the invention is that the first drive element 12 is less sensitive to transistor-to-transistor variation as the slope of the light-to-voltage curve 41 is much smaller compared to a transistor that would cover the full range. Therefore, a lower brightness level than L1 can be obtained with acceptable non-uniformity using transistor 12 than in a conventional pixel cell.

A possible way to further lower the level L1 without lowering the applied gate voltage is to use time modulation techniques. In other words, the emission time of the OLED is modulated so that the average light during the frame period is reduced.

Different ways to achieve time modulation of the OLEDs are available.

With cathode pulsing, the frame period is divided into two periods. During the first period the common cathode is set to a value (for example equal to the power level) preventing current from flowing through the OLED and thereby avoiding light emission. During the second period the cathode is returned to normal voltage and the pixels emit light as usual.

Another technique is to double the frame time and to control the pixels to emit light only during every other frame, while turning them off in between.

Still another solution is to add switches to reset the driving units.

Different drive schemes can be employed to achieve the selection of drive element. According to one alternative, the data signal is enabled during an entire frame period, and the select signal(s) are adjusted to select the desired drive element(s) during this period. This requires independent control of the select signals for each frame period.

Figure 7:
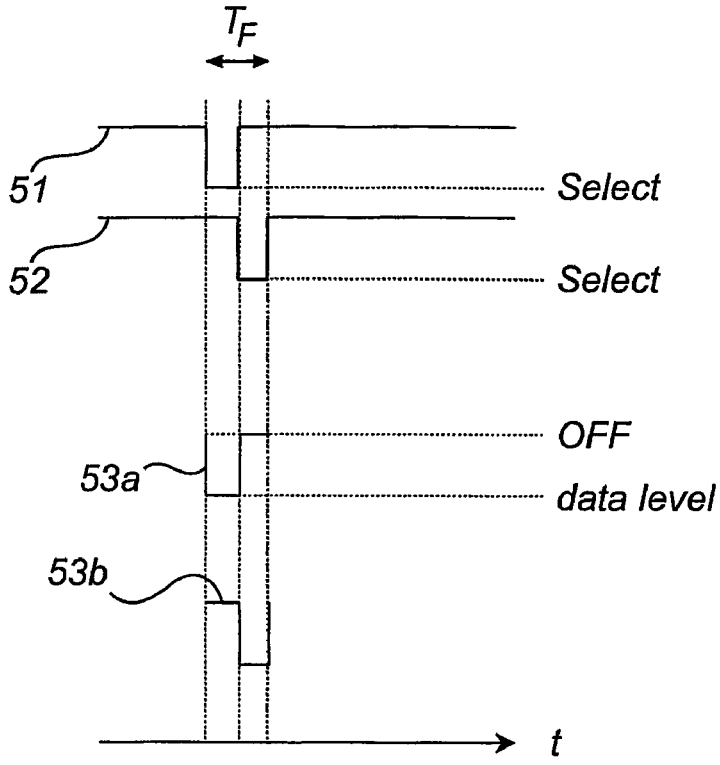
FIG. 7 is a timing diagram for the data and select signals received by the pixel circuit in FIG. 5.

According to another alternative, illustrated in FIG. 7, the each switch 51, 52 is enabled during a portion of the frame period $T_F$. The data signal 53*a*, 53*b* is adapted correspondingly, so that it is enabled during only the portion when the correct drive element is selected. The signal 53*a* represents applying the data signal to the first drive element (enabled when select signal 51 is enabled), while the signal 53*b* represents applying the data signal to the second drive element. This alternative is presently preferred, as it allows applying the same alternating select signals all the time, while adapting the data signal for each frame period according to the desired drive current range.

Further, as is clear from FIG. 7, in the preferred embodiment the two transistors are not activated (ON) at the same time. It may be advantageous to arrange for this possibility, in which case the maximum available brightness level would be the sum of L2 and L3 in FIG. 6. If the transistor can be activated simultaneously the pixel cell will have some redundancy, and values in the range [L2, L3] can be obtained both from the second drive element 14, or from the first and second drive elements 12, 14 in combination. On the other hand, the new range [L3, L3+L2] is made available.

Returning to FIG. 3, the display controller 9, which is connected to the row and column drivers 7, 8, is arranged to receive a video data signal 61 representative of the image to be displayed. The data signal 61 contains information about the brightness level of each pixel, for example a gray-scale level. Each pixel value is an analogue voltage level (V) in a specific range [$V_{min}$, $V_{max}$] corresponding to a pixel brightness level (L) in a specific range.

According to the invention, the display controller 9 is provided with means for mapping this data signal 61 onto a set of smaller ranges, [$V_{min}(x)$, $V_{max}(x)$], x=1, 2, . . . , each corresponding to a desired operating range of the corresponding transistor, thereby generating a data input voltage ($V_{in}$) for the pixel cell. According to the above, the gate-to-source voltage corresponding to $V_{min}(x)$ is much larger than the absolute value of $V_t(x)$, where $V_t(x)$ is the threshold voltage of the transistor x. The mapping means can include a look-up table 62, and suitable software arranged in the display controller 9. The mapping means are also arranged to adapt the timing of the data signal in relation to at least one select signal (e.g. according to FIG. 7), in order to indicate which drive element the data signal is intended for. The control can be performed directly in the controller 9, by providing the row and column drivers 7, 8 with data and select signals timed according to the invention. The control can alternatively be performed indirectly, by providing the drivers 7, 8 with a control signal ($a_0$), in order to enable the drivers to perform suitable timing of the data and select signals (e.g. according to FIG. 7).

Note, as mentioned above, that the select signal can comprise one or several signals, depending on the design of the pixel cells.

In the case of two driving transistors, there are two voltage ranges, where the first range (x=1) corresponds to brightness levels in the range [$L_1$, $L_2$], and the second range (x=2) to levels in the range [$L_2$, $L_3$]. In other words, voltages equal to the lower and upper limits $V_{min}(1)$ and $V_{max}(1)$ of the first range will result in brightness L1 and L2 respectively when connected to the gate of the first transistor T1. Similarly, voltages equal to the lower and upper limits $V_{min}(2)$ and $V_{max}(2)$ of the second range will result in brightness L2 and L3 respectively when connected to the gate of the second transistor T2. Further, to avoid redundancy, a voltage equal to $V_{max}(1)$ connected to the T1 gate results in the same brightness (L2) as a voltage equal to $V_{min}(2)$ connected to the T2 gate.

A control signal $a_0$ signifies to which drive element (first or second) that the resulting analogue data signal ($V_{in}$) should be connected to, in order to result in the desired brightness. As mentioned above, the control signal is not necessarily generated explicitly, but suitable timing can be performed directly by the controller 9.

As mentioned above, data signals corresponding to brightness levels below $L_1$ need to be treated separately, and in the presently described example, such data signal levels are simply mapped to a value $V_0$ such that the resulting gate-to-source voltage is lower than the threshold voltage. This results in the following mapping:

$$L<L1 \Rightarrow V_{in}=V_0$$

$$L1 \leqq L<L2 \Rightarrow V_{min}(1) \leqq V_{in}<V_{max}(1), a_0=0$$

$$L2<L \leqq L3 \Rightarrow V_{min}(2) \leqq V_{in}<V_{max}(2), a_0=1$$

In a special case $V_t(1)=V_t(2)$ and $V_{max}(1)$ is chosen in accordance with $W_1$ and $W_2$ in such a way that $V_{min(2)}=V_{min(1)}$, as is illustrated in FIG. 6, where they both are 4 V. Further, $V_{max(1)}$ can be chosen equal to $V_{max(2)}$, as also is illustrated in FIG. 6 where they both are 6.5 V. In the example in FIG. 6, a data signal (V) between 2 V and 6.5 V is thus mapped onto one single voltage range from around 4 V to around 6.5 V, and a control signal ($a_0$) equal to 0 or 1 is generated to signify the correct drive element.

It should be noted that the preferred embodiments described above may be modified by the skilled man without departing from the scope of the appended claims. For example, more than two drive elements may be included in the pixel cell, if this is considered advantageous. The principle illustrated in FIG. 6 remains essentially the same. Also, other components may be used as switches and drive elements, replacing or supplementing the transistors of PMOS and NMOS type mentioned above. The memory element does not need to be a capacitor, but can equally well be another type of static memory.

Furthermore, the invention has been described in relation to an OLED display, but it is clear to the skilled man that the principles of the invention can be extended to other current driven emissive displays with active matrix addressing, like for example Field Emission Displays and Electro-Luminescent Displays.

The invention claimed is:

1. A pixel cell in an active matrix display comprising:

a current driven emissive element, a data input for receiving an analog data signal ($V_{in}$), at least two drive elements, each being connected to a power supply and arranged to drive the emissive element in accordance with said analog data signal ($V_{in}$), selecting means for selecting one or more of the at least two drive elements in response to one or more select signals, and for providing said data signal ($V_{in}$) to the selected one or more drive elements, wherein each drive element is adapted to drive the emissive element in a different drive current range in response to a given voltage of the analog data signal ($V_{in}$), wherein when the analog data signal having a first voltage is provided to a first one of the drive elements for a duration of time and said first drive element is selected to drive the emissive element, a brightness of the emissive element is greater than when the analog data signal having the first voltage is provided to a second one of the drive elements for the duration of time and said second drive element is selected to drive the emissive element, and wherein the analog data signal has a desired voltage range to provide a desired brightness range, and wherein a separation between a lower value of the desired voltage range and threshold voltages of the at least two drive elements is increased by mapping the desired voltage range onto a smaller voltage range for providing the desired brightness range.

2. A pixel cell according to claim 1, wherein said selecting means comprises at least two switches, each arranged to be provided with a separate one of the select signals, said select signals determining the drive current range resulting from a given data signal ($V_{in}$).

3. A pixel cell according to claim 2, wherein, during a frame period ($T_F$), each switch is arranged to receive a select signal which is set either ON or OFF and in response thereto, when the select signal is ON the switch causes a corresponding one of the drive elements to drive the emissive element, and when the select signal is OFF, the switch causes the corresponding drive element to not drive the emissive element.

4. A pixel cell according to claim 2, wherein during a frame period ($T_F$), each switch is arranged to receive a select signal which is alternatively ON and OFF, and wherein said data signal ($V_{in}$) is enabled only during a portion of the frame period, and wherein when the select signal is ON the switch causes a corresponding one of the drive elements to drive the emissive element, and when the select signal is OFF, the switch causes the corresponding drive element to not drive the emissive element.

5. A pixel cell according to claim 1, where the drive elements comprise transistors having different transistor channel dimensions.

6. A pixel cell according to claim 1, where the current driven emissive element is an organic LED (OLED).

7. The pixel cell of claim 1, wherein each drive element is directly connected to the power supply.

8. The pixel cell of claim 1, wherein when the one or more select signals have a first state, the selecting means selects only a first one of the drive elements to drive the emissive element, and when the one or more select signals have a second state, the selecting means selects only a second one of the drive elements to drive the emissive element.

9. The pixel cell of claim 1, wherein the two drive elements generate different drive current ranges for a same data signal range.

10. A display device, comprising:

a plurality of pixel cells, each pixel cell comprising:

a current driven emissive element, a data input for receiving an analog data signal ($V_{in}$), at least two drive elements, each being connected to a power supply and arranged to drive the emissive element in accordance with said analog data signal ($V_{in}$), selecting means for selecting one or more of the at least two drive elements in response to one or more select signals, and for providing said data signal ($V_{in}$) to the selected one or more drive elements, wherein each drive element is adapted to drive the emissive element in a different drive current range in response to a given voltage of the analog data signal ($V_{in}$); and a controller, arranged to receive an analog video signal belonging to a first voltage range, to generate the analog data signal ($V_{in}$) belonging to a second, more narrow voltage range, and to associate said analog data signal ($V_{in}$) with a select signal indicating a desired drive current range; and means for providing said analog data signal ($V_{in}$) and said select signal to one of said pixel cells;

wherein when the analog data signal having a first voltage is provided to a first one of the drive elements for a duration of time and said first drive element is selected to drive the emissive element, a brightness of the emissive element is greater than when the analog data signal having the first voltage is provided to a second one of the drive elements for the duration of time and said second drive element is selected to drive the emissive element, and wherein the analog data signal has a desired voltage range to provide a desired brightness range, and wherein a separation between a lower value of the desired voltage range and threshold voltages of the at least two drive elements is increased by mapping the desired voltage range onto a smaller voltage range for providing the desired brightness range.

11. A display device according to claim 10, wherein said first voltage range comprises voltages which are closer to threshold voltages of the pixel cell drive elements than any voltages in said second voltage range.

12. The display device of claim 10, wherein each drive element is directly connected to the power supply.

13. The display device of claim 10, wherein when the one or more select signals have a first state, the selecting means selects only a first one of the drive elements to drive the emissive element, and when the one or more select signals have a second state, the selecting means selects only a second one of the drive elements to drive the emissive element.

14. A method for driving a pixel cell comprising an emissive element and at least two drive elements for driving the emissive element, each drive element being adapted to drive the emissive element in a different drive current range in response to a given data signal ($V_{in}$) said method comprising:

based on an analog video signal belonging to a first voltage range, generating an analog data signal ($V_{in}$) belonging to a second, more narrow voltage range, and associating said analog data signal with one or more select signals indicating a desired drive current range, and, in response to the one or more select signals, providing said analog data signal ($V_{in}$) to a selected one or more of the drive elements in the pixel cell to drive the emissive element in the desired drive current range, wherein when the analog data signal having a first voltage is provided to a first one of the drive elements for a duration of time and said first drive element is selected to drive the emissive element, a brightness of the emissive element is greater than when the analog data signal having the first voltage is provided to a second one of the drive elements for the duration of time and said second drive element is selected to drive the emissive element, and wherein the analog data signal has a desired voltage range to provide a desired brightness range, and wherein a separation between a lower value of the desired voltage range and threshold voltages of the at least two drive elements is increased by mapping the desired voltage range onto a smaller voltage range for providing the desired brightness range.

15. A method according to claim 14, wherein said first voltage range comprises voltages which are closer to threshold voltages of the pixel cell drive elements than any voltages in said second voltage range.

16. A method according to claim 14, wherein said one or more select signals comprise at least two select signals, each connected to a separate switch.

17. A method according to claim 14, wherein, during a frame period ($T_F$), each select signal is set either ON or OFF.

18. A method according to claim 14, wherein, during a frame period ($T_F$), each select signal only is set ON during a portion of the frame period, and said data signal ($V_{in}$) only is enabled during a portion of the frame period.

* * * * *